US006571416B2

(12) United States Patent
Hirse

(10) Patent No.: US 6,571,416 B2
(45) Date of Patent: Jun. 3, 2003

(54) SURFACE CLEANING DEVICE

(75) Inventor: Gernot M. Hirse, Frankfurt (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/990,529

(22) Filed: Nov. 20, 2001

(65) Prior Publication Data

US 2002/0083540 A1 Jul. 4, 2002

(30) Foreign Application Priority Data

Nov. 25, 2000 (DE) ..... 100 58 629

(51) Int. Cl.[7] ..... A47L 13/12; A46B 5/00

(52) U.S. Cl. ..... 15/106; 15/159.1; 15/176.1; 15/DIG. 5

(58) Field of Search ..... 15/106, 159.1, 15/160, 176.1, 202, DIG. 5, 146, 166

(56) References Cited

U.S. PATENT DOCUMENTS 2,732,578 A * 1/1956 Hawkins
2,814,066 A * 11/1957 Lesh, Jr.
4,756,039 A * 7/1988 Pardo
5,319,824 A * 6/1994 Cook, III
5,517,710 A * 5/1996 Hisey

FOREIGN PATENT DOCUMENTS

DE 213934 * 2/1909

* cited by examiner

*Primary Examiner*—Randall E. Chin
(74) *Attorney, Agent, or Firm*—Kenyon & Kenyon

(57) ABSTRACT

A surface cleaning device comprising a broom (1) and a brush (2), each having bristles (4, 5) on the side facing the surface to be cleaned (3) wherein the broom (1) and the brush (2) can be affixed one to the other in a fashion which can be detached without damage and wherein the bristles (4, 5) at the broom (1) and the brush (2) form a functional unit (6) when the brush (2) is affixed to the broom (1).

20 Claims, 4 Drawing Sheets

SURFACE CLEANING DEVICE

BACKGROUND OF THE INVENTION

1. Field of the Invention

The invention pertains to a device used to clean surfaces.

2. Description of Related Art

Surface cleaning devices are widely known and may take the form of brooms or brushes, for example. In order to be able to clean surfaces of varying-sizes as efficiently as possible several different sizes of broom and brushes are, for example, required. A multitude of surface cleaning devices cannot, however, be stored in a space-saving fashion. Moreover, procuring a large number of variously sized surface cleaning devices for better adaptation to the particulars of the application is not satisfactory from an economic point of view.

SUMMARY OF THE INVENTION

It is an object of the invention to further refine a surface cleaning device so that it comprises only a few components in total, is easy and economical to manufacture, is versatile in use, is highly adaptable to the particular situation in the application as needed and can be stored in a space-saving fashion.

These and other objects of the invention are attained by a surface cleaning device comprising a broom (1) and a brush (2), each exhibiting bristles (4, 5) facing the surface (3) to be cleaned wherein the broom (1) and the brush (2) can be affixed one to the other so as to be detachable without damage and wherein the bristles (4, 5) of the broom (1) and brush (2) form a functional unit (6) when the brush (2) is attached to the broom (1).

BRIEF DESCRIPTION OF THE DRAWINGS

The present invention will be described in greater detail with reference to the following drawings wherein.

DETAILED DESCRIPTION OF THE INVENTION

The surface cleaning device includes a broom with broomstick and a brush, each of which exhibits bristles on the side facing the surface to be cleaned, wherein the broom and the brush can be affixed one to the other so as to be detachable without damage and wherein the bristles of the broom and the brush form a functional unit when the brush is affixed to the broomstick. Here it is advantageous that the surface cleaning device in accordance with the invention comprise only a small number of parts, is quite variable and thus can be adapted as required and in excellent fashion to the situation prevailing at the application, for example, to differing sizes of surfaces to be cleaned. Small surfaces can, for example, be cleaned either exclusively with the broom or exclusively with the brush. If the surfaces to be cleaned are larger, then the broom and the brush are affixed one to the other and the bristles form the relatively larger functional unit. The surface cleaning device in accordance with the invention satisfies the same requirements as a large broom, an additional small broom and a further brush, even though the surface cleaning device comprises two components, namely the broom and the brush, which can be affixed one to the other.

Figure 1:
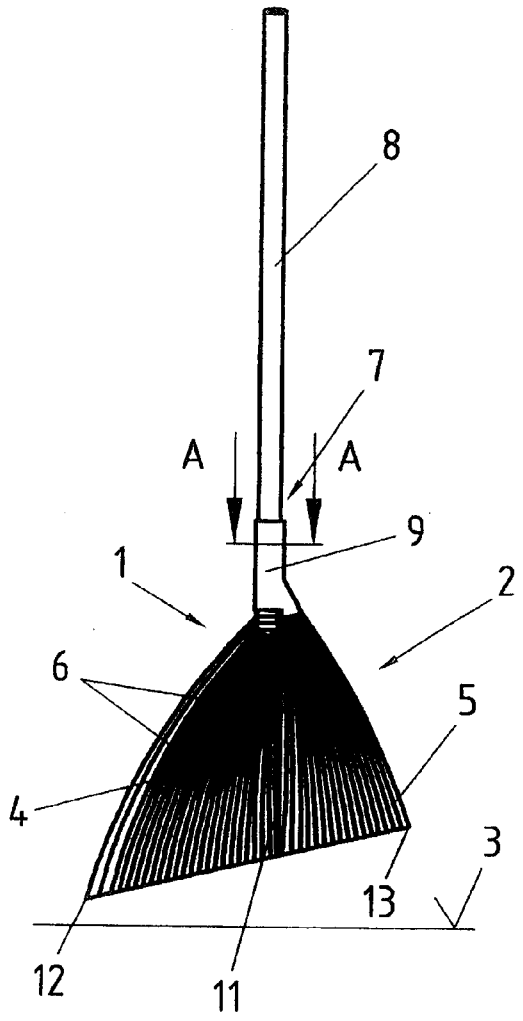
FIG. 1 shows a surface cleaning device in accordance with the invention with the brush attached to the broom.

Shown in FIG. 1 is a surface cleaning device comprising a broom 1 and a brush 2 which are affixed one to the other so as to be detachable without damage. The bristles 4, 5 of the broom 1 and the brush 2 form a functional unit 6 for cleaning comparatively larger surfaces.

The broomstick 8 and the handle 9 in this embodiment are made of a polymer material and are joined one with another so as to prevent relative rotation. The anti-rotation feature 7 is achieved by a polygonal cross-section of the broomstick 8 and a corresponding, congruent opening in the handle 9, wherein the handle 9 surrounds and is in contact with the broomstick 8 at its outside circumference.

The bristles in this embodiment exhibit continuously diminishing lengths from the leading edge 12 of the broom 1 to the trailing edge 13 of the brush 2.

Figure 2:
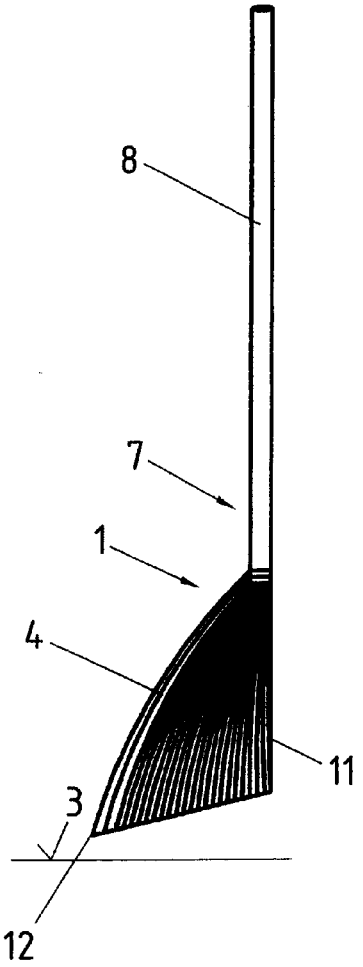
FIG. 2 shows the broom as a separate component.

In FIG. 2 the broom 1 is depicted as a separate component. The bristles 4 of the broom 1 are arranged essentially in a quarter circle wherein the limit 11 for the quarter-circle-shaped bristle segment facing the brush 2 forms a direct extension of the broomstick 8. The broom 1 can also be used without the brush 2 being affixed to it, to clean smaller surfaces, for example.

Figure 3:
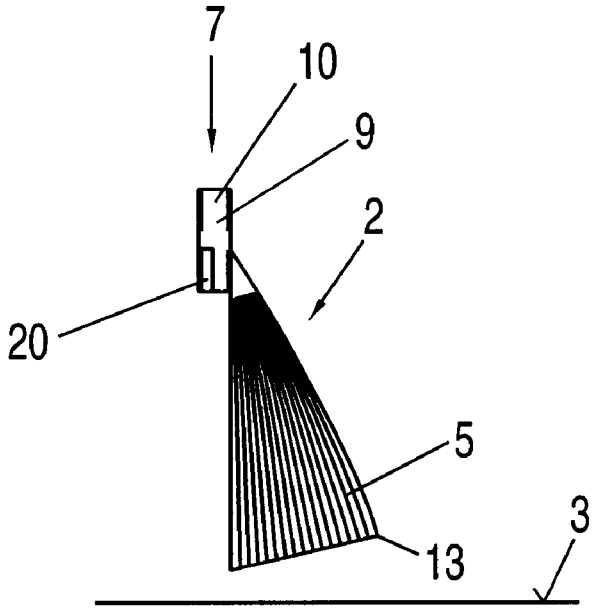
FIG. 3 shows the brush as a separate component.

In FIG. 3 the brush 2 is depicted as a separate component. The handle 9 is shaped in such a way that it can be affixed to the broomstick 8 with either a positive-fit and/or frictional connection. The bristles 5 of the brush 2, arranged in this embodiment in a quarter circle are arranged so that the unit 6 comprising the bristles 4 of the broom 1 and the bristles 5 of the brush 2 are essentially semi-circular in shape.

The brush 2 can also be used separately, in the same way as the broom 1.

Figure 4:
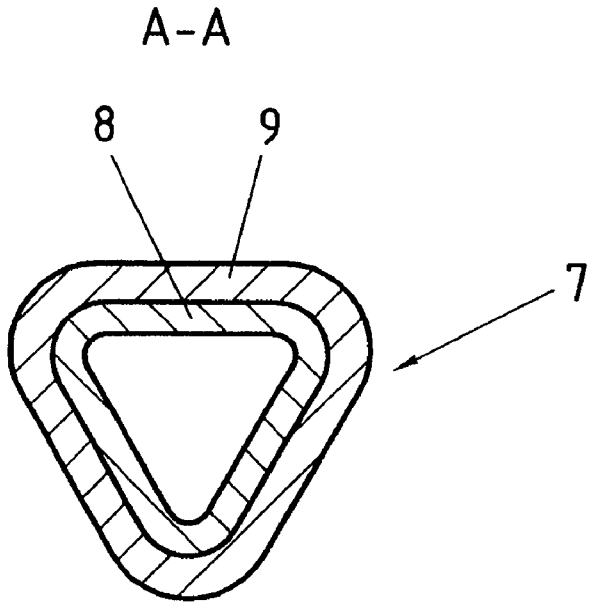
FIG. 4 shows a section along plane A—A in FIG. 1.

FIG. 4 shows the section along plane A—A in FIG. 1. Both the outside circumference of the broomstick 8 and the opening 10 in the handle 9 are polygonal and exhibit an essentially triangular cross-section. This polygonal design results in a simple anti-rotation feature 7, without requiring additional components such as, for example, clamping screws.

The surface cleaning device can thus be modified variably to suit the particular situation at the particular application, can be stored easily and in a space-saving fashion and can be manufactured economically.

The broom and the brush may be affixable one to another by way of either a frictional and/or positive-fit connection. A frictional connection can, for example, be created by the broomstick and the handle of the brush being clamped together by way of a transitional fit. A positive-fit connection can, for example, be effected by locking cams and corresponding notches which are shaped congruently so that the locking cam of the broom or the brush engage with the notches at the brush or the broom. A combination of the two types of connection is also conceivable. Simple affixing of the broom and the brush one to another, without play, is thus possible.

The broom and the brush may exhibit a common device to prevent mutual rotation. Thus the bristles in the broom and the brush are always positioned exactly with reference one to another, which is of an advantage to be emphasized in reference to simple surface cleaning.

The brush can be affixed to the broom, for example, by the broom exhibiting a broomstick and the brush exhibiting a handle, that handle exhibiting an opening which is congruent with the outside circumference of the broomstick. The handle may, for example, be of a closed, ring-shaped design and surround the broomstick completely at its outside circumference. Advantageous here is that the broom and the brush are then attached one with another so as to prevent loss if the forces applied via the broomstick or the handle are relatively great. Assembly is effected by the handle with its ring-shaped opening being slid over the broomstick, consequently surrounding the latter concentrically.

The broomstick and/or the handle will preferably be of an ergonomically favorable design, polygonal with three outside surfaces, for example, when viewed in cross-section. The surface cleaning device can in this way be grasped especially well.

In accordance with another embodiment it is possible for the handle to be of a slotted design in the longitudinal direction of the broomstick and be clamped together by way of a transitional fit. A positive-fit connection can, for example, be effected by locking cams and corresponding notches which are shaped congruently so that the locking cam of the broom or the brush engage with the notches at the brush or the broom. A combination of the two types of connection is also conceivable. Simple affixing of the broom and the brush one to another, without play, is thus possible.

The broom and the brush may exhibit a common device to prevent mutual rotation. Thus the bristles in the broom and the brush are always positioned exactly with reference one to another, which is of an advantage to be emphasized in reference to simple surface cleaning.

The brush can be affixed to the broom, for example, by the broom exhibiting a broomstick and the brush exhibiting a handle, that handle exhibiting an opening which is congruent with the outside circumference of the broomstick. The handle may, for example, be of a closed, ring-shaped design and—surround the broomstick completely at its outside circumference. Advantageous here is that the broom and the brush are then attached one with another so as to prevent loss if the forces applied via the broomstick or the handle are relatively great. Assembly is effected by the handle with its ring-shaped opening being slid over the broomstick, consequently surrounding the latter concentrically.

The broomstick and/or the handle will preferably be of an ergonomically favorable design, polygonal with three outside surfaces, for example, when viewed in cross-section. The surface cleaning device can in this way be grasped especially well.

In accordance with another embodiment it is possible for the handle to be of a slotted design in the longitudinal direction of the broomstick and be snap-mountable to the outside circumference of the broomstick. For example, FIG. 3 shows the handle 9 including slot 20. Of advantage here is that handling for the surface cleaning device is particularly simple. To attach the brush to the broomstick, the handle slotted in the longitudinal direction is simply deformed elastically and snapped onto the broomstick. Sliding the handle over the free end of the broomstick, which faces away from the bristles, is thus not required. Simple affixing of the broom and the brush one to another, without play, is thus possible.

A simple method for protection against rotation is given, for example, by the broomstick being designed so as to exhibit an essentially polygonal cross-section.

Over and above this there is a possibility to realize the anti-rotation feature by using at least one ball detent. A ball in the broomstick or the handle, to which spring action is applied, engages in a notch of congruent shape in the handle or the broomstick.

To achieve the maximum versatility in application of the surface cleaning device it has proven to be advantageous that the bristles of the broom and the brush be arranged essentially in the shape of a quarter circle and that the bristles for the brush be affixed to the broomstick to form an essentially semi-circular unit. Both the broom and the brush can each be utilized separately for smaller surfaces. To clean larger surfaces the broom and the brush are affixed one to the other. Thus there results, for example, a doubling of the wiping area of the broom or the brush.

Depending on the shape which the cross-sectional area of the polygonal broomstick exhibits it is possible to arrange the brush rotated relative to the broom so that the bristles are then arranged in an angle of 30° or 90° one to the other.

In order to obtain predictable work results, largely independent of the way in which the surface cleaning device is held and/or the direction of cleaning, the bristles of the broom and the brush may be formed essentially identically and exhibit an essentially identical hardness.

Deviating from this, however, it is also possible for the bristles at the broom and brush to differ and/or to exhibit hardnesses differing one from the other, An embodiment such as this can be advantageous if, for example, the soiling on the surface to be cleaned is greater in the edge area than in the middle. Then the edge area could, for example, be cleaned with the harder bristles of the broom and the center of the surface with the comparatively softer bristles of the brush.

The bristles of the broom and the brush may exhibit differing lengths and/or differing hardnesses, differing one from another. The bristles from the leading edge of the broom to the trailing edge of the brush can exhibit continuously declining lengths. Handling is improved by the shape of the surface cleaning device, sloped from the leading edge to the trailing edge. If the broomstick is held at an angle to the surface to be cleaned in order to clean larger surfaces, then all the bristles will nonetheless be essentially in contact with the surface to be cleaned so that even large areas can be cleaned in a short period of time with the surface cleaning device being hold at an angle which is ergonomically favorable for the user.

The broomstick and the handle are preferably made of a polymer material. Here it is an advantage that the surface cleaning device can also be used outdoors and/or in damp rooms without the broomstick and/or handle corroding.

What is claimed is:

1. A surface cleaning device comprising a broom (1) and a brush (2), each having bristles (4, 5) facing a surface (3) to be cleaned, wherein the broom (1) and the brush (2) can be affixed one to the other so as to be detachable without damage and wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8).

2. The surface cleaning device according to claim 1, wherein the broom (1) and the brush (2) are affixable one to another by either positive or frictional fit.

3. The surface cleaning device according to claim 1, wherein the broom (1) and the brush (2) do not rotate relative to each other.

4. The surface cleaning device according to claim 1, wherein the handle (9) has a closed, ring-shaped design and completely surrounds the outside circumference of the broomstick (8).

5. The surface cleaning device according to claim 1, wherein the bristles (4, 5) of the broom (1) and the brush (2) have one of lengths and hardnesses which differ one from the other.

6. The surface cleaning device according to claim 1, wherein the broomstick (8) and the handle (9) are made of a polymer material.

7. A surface cleaning device comprising a broom (1) and a brush (2), each having bristles (4, 5) facing a surface (3) to be cleaned, wherein the broom (1) and the brush (2) can be affixed one to the other so as to be detachable without damage wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8), wherein the handle (9) has a slot in the longitudinal direction of the broomstick (8) and is snap-mountable on the outside circumference of the broomstick (8).

8. A surface cleaning device comprising a broom (1) and a brush (2), each having bristles (4, 5) facing a surface (3) to be cleaned, wherein the broom (1) and the brush (2) can be affixed one to the other so as to be detachable without damage and wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8), and wherein the broomstick (8,) has an essentially polygonal cross-section.

9. The surface cleaning device according to claim 8, wherein the handle (9) has a closed, ring-shaped design and completely surrounds the outside circumference of the broomstick (8), and wherein the broomstick (8) has an essentially polygonal cross-section.

10. The surface cleaning device according to claim 8, wherein the handle (9) has a slot in the longitudinal direction of the broomstick (8) and is snap-mountable on the outside circumference of the broomstick (8), and wherein the broomstick (8) has an essentially polygonal cross-section.

11. A surface cleaning device comprising a broom (1) and a brush (2), each having bristles (4, 5) facing a surface (3) to be cleaned, wherein the broom (1) and the brush (2) can be affixed one to the other so as to be detachable without damage wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8), wherein the bristles (4, 5) of the broom (1) and the brush (2) are arranged essentially in a quarter circle and the bristles (4, 5) form an essentially semi-circular unit (6) when the brush (2) is affixed to the broom (1).

12. A surface cleaning device comprising a broom (1) and a brush (2), each having bristles (4, 5) facing a surface (3) to be cleaned, wherein the broom (1) and the brush (2) can be affixed one to the other so as to be detachable without damage wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8), wherein the bristles (4, 5) of the broom (1) and brush (2) are essentially identical and have essentially the same hardness.

13. A surface cleaning device comprising a broom (1) and a brush (2), each having bristles (4, 5) facing a surface (3) to be cleaned, wherein the broom (1) and the brush (2) can be affixed one to the other so as to be detachable without damage wherein the bristles (4, 5) of the broom (1) and brush (2) form a functional unit (6) when the brush (2) is attached to the broom (1), and wherein the broom (1) has a broomstick (8) and the brush (2) has a handle (9) and the handle (9) defines an opening (10) congruent with the outside circumference of the broomstick (8), wherein the bristles (4, 5) have continuously decreasing lengths from the leading edge (12) of the broom (1) to the trailing edge (13) of the brush (2).

14. A surface cleaning device, comprising:

a broom including a broomstick and a plurality of bristles; and a brush including a handle defining an opening congruent with an outside circumference of the broomstick, the brush further including a plurality of bristles, wherein the broom and the brush are detachably coupleale to one another, and the bristles of the broom and brush form a single functional unit when the brush is coupled to the broom.

15. The surface cleaning device according to claim 14, wherein the broom and the brush are detachably coupleale to one another by one of a positive and a frictional fit.

16. The surface cleaning device according to claim 14, further comprising:

an anti-rotation feature configured to prevent the broom and the brush from rotating relative to one another.

17. The surface cleaning device according to claim 14, wherein the handle of the brush has a closed and ring-shaped design, and the handle of the brush completely surrounds the outside circumference of the broomstick when the brush is coupled to the broomstick.

18. A surface cleaning device, comprising:

a broom including a broomstick and a plurality of bristles; and a brush including a handle defining an opening congruent with an outside circumference of the broomstick, the brush further including a plurality of bristles, wherein the broom and the brush are detachably coupleable to one another, and the bristles of the broom and brush form a single functional unit when the brush is coupled to the broom, wherein the handle of the brush has a slot in a longitudal direction of the broomstick, and the handle of the brush is snap-mountable on the outside circumference of the broomstick.

19. A surface cleaning device, comprising:

a broom including a broomstick and a plurality of bristles; and a brush including a handle defining an opening congruent with an outside circumference of the broomstick, the brush further including a plurality of bristles, wherein the broom and the brush are detachably coupleable to one another, and the bristles of the broom and brush form a single functional unit when the brush is coupled to the broom, wherein the bristles of the broom and the brush are each arranged essentially in a quarter circle, and the bristles of the broom and the brush form an essentially semi-circular unit when the brush is coupled to the broom.

20. A surface cleaning device, comprising:

a broom including a broomstick and a plurality of bristles; and a brush including a handle defining an opening congruent with an outside circumference of the broomstick, the brush further including a plurality of bristles, wherein the broom and the brush are detachably coupleable to one another, and the bristles of the broom and brush form a single functional unit when the brush is coupled to the broom, wherein the bristles of the broom and the brush have essentially the same hardness.

* * * * *